United States Patent [19]

Lendi

[11] 4,054,214

[45] Oct. 18, 1977

[54] PLURAL VEHICLE PARKING DEVICE

[75] Inventor: Ulrich Lendi, Stafa, Switzerland

[73] Assignee: Firma Mageba S.A., Bulach, Switzerland

[21] Appl. No.: 684,682

[22] Filed: May 10, 1976

Related U.S. Application Data

[63] Continuation of Ser. No. 508,140, Sept. 20, 1974, abandoned.

[51] Int. Cl.[2] ..... E04H 6/06

[52] U.S. Cl. ..... 214/16.1 C; 214/16.1 R; 214/16.1 E

[58] Field of Search ..... 214/16.1 E, 16.1 EC, 214/16.1 A, 16.4 R, 16.4 A, 16.1 R

[56] References Cited

U.S. PATENT DOCUMENTS

| | | | |
|---|---|---|---|
| 3,338,433 | 8/1967 | Mattson et al. | 214/16.4 R |
| 3,559,822 | 2/1971 | Lichtenford | 214/16.4 A X |
| 3,591,023 | 7/1971 | Allen | 214/16.4 R |
| 3,710,956 | 1/1973 | Meyer et al. | 214/16.1 CE |
| 3,741,412 | 6/1973 | Klaus | 214/16.1 ED |

*Primary Examiner*—Albert J. Makay
*Assistant Examiner*—R. B. Johnson
*Attorney, Agent, or Firm*—William Anthony Drucker

[57] ABSTRACT

A device for parking two vehicles one above the other has a support structure to house the vehicles, guide rail means in said support structure and movable vertically therein for shifting of a vehicle into an upper position in the support structure, and a vehicle-holding device to receive the vehicle to be moved to the upper position, the vehicle-holding device being carried by and movable along the guide rail means.

2 Claims, 15 Drawing Figures

PLURAL VEHICLE PARKING DEVICE

CROSS REFERENCE TO RELATED APPLICATION

This is a continuation of application Ser. No. 508,140, filed Sept. 20, 1974, now abandoned.

The invention relates to a device for parking two vehicles one above the other, with a holding device for the upper vehicle which can be lifted from the ground and if necessary is suspended so as to be rotatable about a vertical axis.

In the case of a well known device of this kind (Swiss patent 518,434), the holding device is moved along a circular path by means of laterally hinged pivoting arms that are supported on the floor and are either lifted or pivoted. For the installation of the well known device in a garage space, this means that the latter, in view of the circular path to be described by the holding device, has to be considerably higher than is necessary as space for two vehicles arranged one above the other. Moreover, in the case of the known device, from the point of view of manufacture relatively great outlay has to be expended if a stable guide of the movement is to be obtained.

In contrast, the object of the present invention is to provide a device of the type mentioned above in which its space requirement in a vertical direction is less, and which is of simplified and cheapened design.

According to the present invention, this problem is solved in that the holding device is guided so as to travel horizontally in the longitudinal direction of the garage, and the guide is supported so as to be vertically adjustable.

Through the vertical adjustability of the guide, the necessary garage space can be made very much lower, viz. fairly accurately equal to the actual height of two vehicles arranged one above the other. By the adoption of simple types of movement, viz. a vertical lifting movement and horizontal shift movement, the construction is made cheaper; the guide arranged to the side of the vehicles being parked assists the stable construction of the device. The rectilinear types of movement make it possible to use relatively small driving devices both for the vertical and for the horizontal movement.

According to a preferred embodiment, the holding device is in the form of a mainly enclosed platform with suspension. In this case the platform is the parking area for the vehicle being held.

According to a variant, a fixed ceiling is provided for parking the upper vehicle and the holding device, with the vehicle parked on the ceiling, is designed to be separable from the latter and/or acts in conjunction with the ceiling. In this case, by means of an independently movable holding device, several positions can be served.

In a particularly simple embodiment the guide consists of horizontal supports, in or on which the guide parts supporting the holding device act. The supports or girders can extend throughout the total length of the horizontal adjustment path.

In a preferred embodiment, in which the guide parts are extendable rails prolonging the supports or girders, it is possible to make do with a very much shorter length of support, the latter corresponding approximately to the length of a garage or a vehicle.

It is desirable for the supports or girders to be supported in a vertical direction by means of a lifting device and to be guided in or on vertical supports. At the same time it is possible to attach, to the supports or girders, guide strips extending vertically and acting in conjunction with the pillars. This contributes to improving the vertical guide properties.

A particularly stable and therefore vibration-free embodiment has the girders (supports) and pillars joined together by stablising transverse parts . Of course the transverse parts run in lateral zones of the device, i.e. outside the floor spaces provided for the vehicles to be parked.

It suffices for a support to be guided on each longitudinal side of the device by two pillars arranged at a distance.

In an embodiment in which the holding device is movable horizontally below the girders, vertical adjustability of the supports between their position below the garage ceiling, and a lowered position approximately in the same height of the garage, suffices.

For embodiments in which the holding device is supported above the girders, their vertical adjustment path can be limited to between an upper position approximately half way up the garage and a position lowered onto the garage floor.

The movement guide adopted makes it possible to arrange separate mechanisms for moving the holding device and the guide parts carrying the latter. If the holding device is provided with a rotating device which makes it possible to receive incoming vehicles transversely to the longitudinal direction of the garage, and then to pivot these in the longtudinal direction of the garage, a special drive can be provided. The drive mechanisms used are hydraulic lifting and adjustment cylinders. For the horizontal shift of the rails that can be extended from the girders a chain drive is an advantage.

Embodiments are described below by reference to the drawings.

FIG. 1 shos the device seen from the side with extended raised holding device and garage cut away;

FIG. 1*a* is a partial section along I*a* —I*a* of FIG. 1;

FIG. 2 is a variant of the device seen from the side with retracted lifted holding device;

FIG. 2*a* is a partial section along II*a* —II*a* of FIG. 2;

Figure 1:
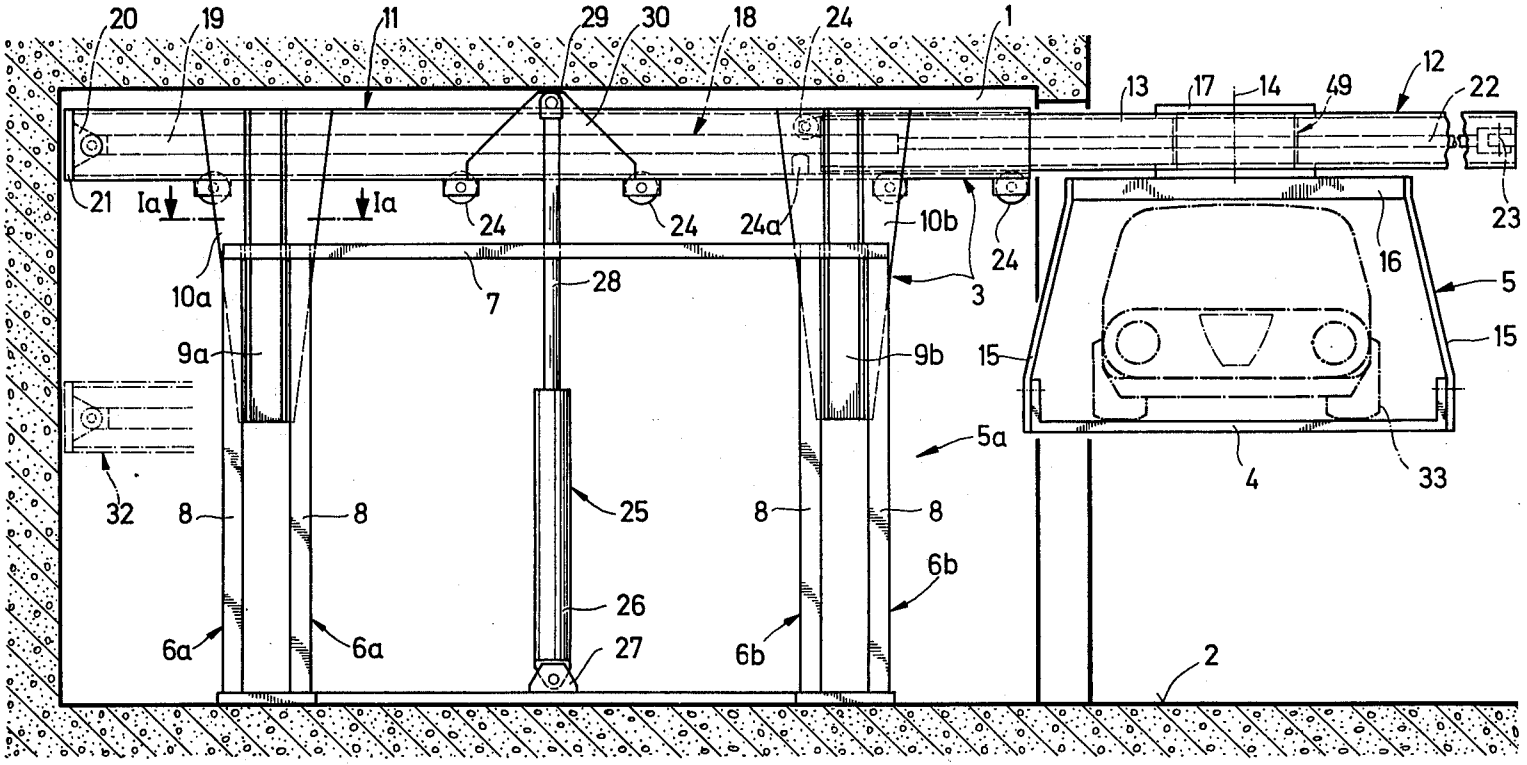

FIG. 1 shows a section close to the wall along a vertical plane through a garage box 1. On the bottom of the garage 2 is the device 3 for parking two vehicles one above the other, the lower vehicle to be parked on the floor of the garage 2 and the upper vehicle on the platform 4 of the holding device. The device 3 comprises a frame 5*a* secured to the floor 2 consisting of pillars 6*a*, 6*b* arranged on each side of the garage, which are joined together via a transverse part in the form of a yoke 7. The pillars 6*a*, 6*b* are formed respectively of two square tubes 8 in whose intermediate space are inserted guide strips 9*a*, 9*b* of U-shaped cross-section. The guide strips 9*a*, 9*b* are attached respectively to a trapezoidal reinforcement plate 10*a*, 10*b* which is rigidly connected with a girder 11 for the horizontal guiding of the holding device 5. Altogether two girders 11 are provided one on each longitudinal side of the device. In the girders 11 is guided a cantilever 12 with lateral rails 13. The holding device 5 is suspended from the cantilever 12 and is rotatable about the vertical axis 14. The platform 4 of the holding device is joined to the lateral struts 15 via the transverse part 15 joining the struts with the rotating part 17. The extension of the cantilever takes place preferably by means of two lifting cylinders 18 which are arranged respectively within the lateral girders 11 or rails 13 and are supported at 24*a*. The cylindrical part 19 of each lifting cylinder is hinged at the free end to an attachment flange 20; the attachment flange 20 is firmly connected to a crosspiece 21 joining the two girders. The piston 22 of each lifting cylinder is attached at its free and to an eye 23 of the extending rails 13. The rails 13 are guided inside the girders 11 on rollers 24. The drive for the lifting movement of the girders 11 consists of the hydraulic lifting cylinders 25 that are allotted to each of the girders. Their cylindrical part 26 is connected by its free end to strips 27 anchored in the floor. Their pistons 28 are supported with the free end in the joint eye 29, which is arranged on the attachment sheet 30 on the outside of the coordinated girder 11. The girders or supports 11 in the representation according to FIG. 1 are shown in the raised position, i.e. barely below the top 31 of the garage compartment 1. The lowered position is denoted by the chain-dotted lines 32. In this position the platform 4 of the holding device lies on the garage floor 2. To bring the vehicles 33 received on the platform 4 into the garage boxes, the holding device and platform are rotated 90 ° about the vertical axis 14 of their suspension; after this the cantilever is entirely retracted, so that it is in the zone between the girders 11.

Figure 1A:
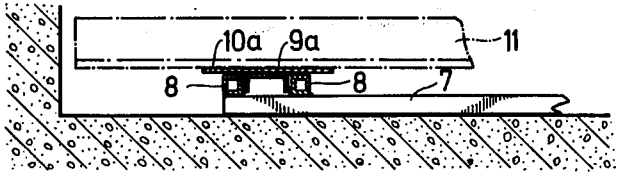

In the partial section according to FIG. 1*a*, the square tubes 8 forming the pillars 6*a*, 6*b* and the U profile forming the guide strips 9*a*, 9*b* are visible in cross-section. The reinforcement plate 10*a* is in its turn attached to the outside of the coordinated girder 11. The square tubes 8 of a longitudinal side of the device are joined together at their upper extremity by means of the yoke 7 to form a fixed frame.

Figure 2:
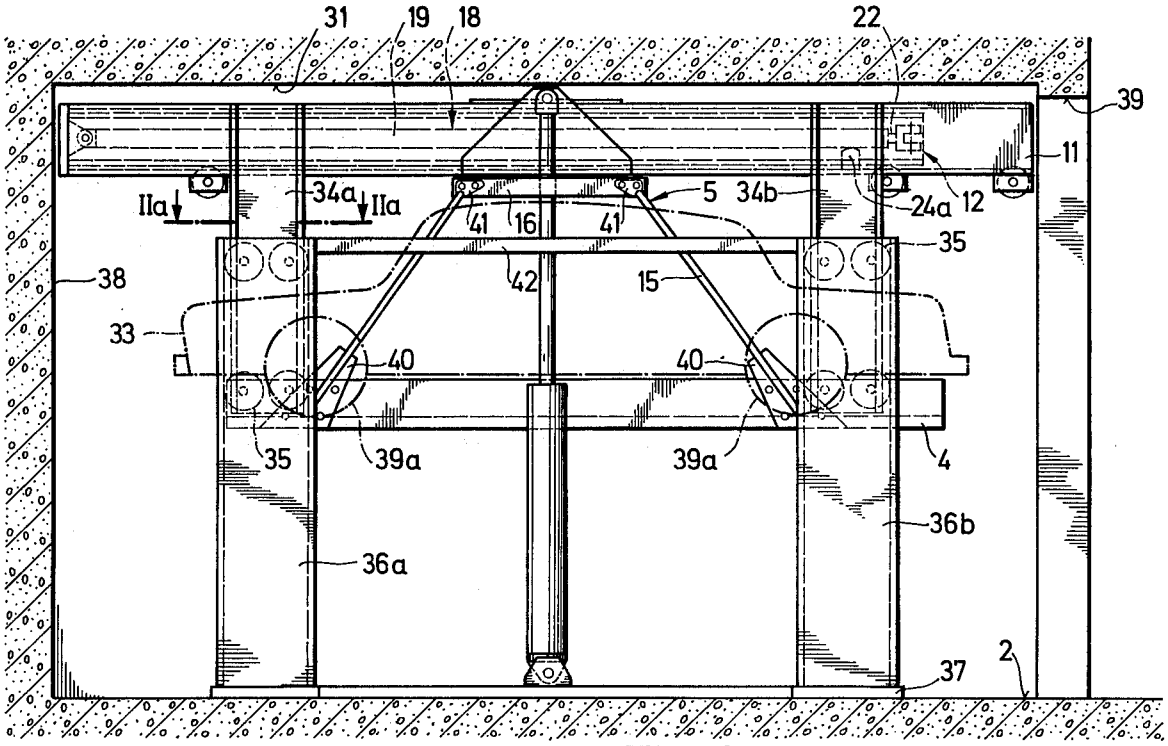

In the representation according to FIG. 2 the cantilever 12 with the holding device 5 is retracted. The girders 11 forming the guides for the cantilever 12 are shown in the raised position. In this way there is produced below the platform 4 of the holding device 5 a free space for a vehicle to be parked underneath.

Different from the embodiments according to FIG. 1 are the guide strips 34*a*, 34*b* which are attached to the girders 11 and guided by means of rollers 35 in pillars 36*a*, 36*b* of U-section shape. The pillars 36*a*, 36*b* are anchored by the baseplate 37 to the floor of the garage 2. The girders 11 have about the same length as the garage box, i.e. they extend from the rear wall 38 of the garage to the opposite drive-in opening 39 of the garage. The supports 36*a*, 36*b* extend from the floor to a height of about ¾ of the height of the inner space of the garage. The guide strips attached to the girders 11 have a length projected downwards beyond the girders of about the height of a vehicle. In the position of the cantilever 2 which is represented in FIG. 2, the piston 22 of the horizontally acting hydraulic cylinder 18 is retracted almost completely into the interior of the cylindrical part 19.

Furthermore in FIG. 2, as distinct from FIG. 1, the holding device 5 is represented as turned through 90 °, corresponding to the retracted position. The vehicle 33 stands with the wheels 39*a* on the platform 4. The platform 4 is rigidly joined by the struts 15 with the transverse part 16 of the turning device. Reinforcement at the lower end of the struts 15 is obtained by the triangular plates 40. At their upper ends, the struts 15 are joined by bent flanges 41 with the transverse part 16.

Figure 2A:
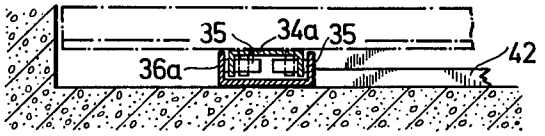

FIG. 2*a* shows in section the U-section of the pillar 36*a* and the U-section of the guide strip 34*a* with the guide rollers 35. The supports 36*a*, 36*b* are joined with the yoke 42 at their upper end to form a fixed part of the frame.

Figure 3:
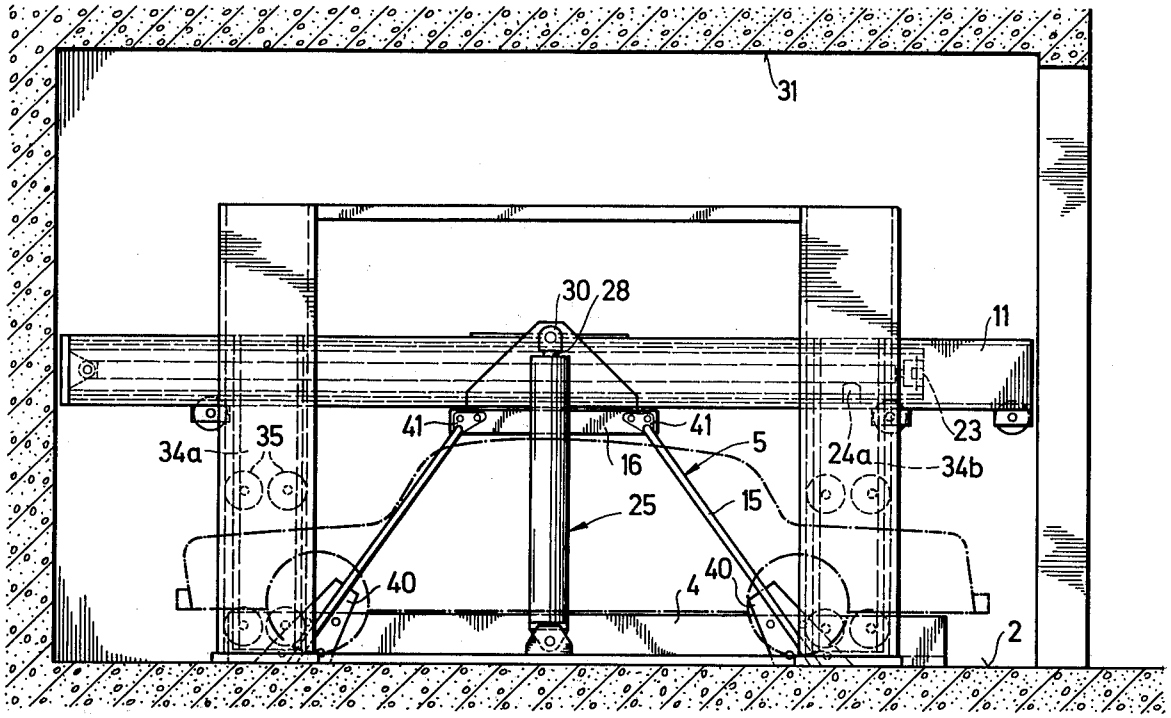
FIG. 3 shows the device according to FIG. 2 likewise seen from the side retracted and lowered receiving device.

FIG. 3 represents the embodiment according to FIG. 2, but with the holding device 5 lowered to the floor of the garage 2. The girders or supports 11 run at about half the height of the inner garage space. The platform 4 lies on the floor. The guide rollers 35 attached rotatably to the guide strips 34*a*, 34*b* are in the bottom position. The piston 28 of the lifting cylinder 25 is completely retracted. The holding device 5 is exactly below or between the attachment plates 30 with the upper support of the lifting cylinder 25.

Figure 4:
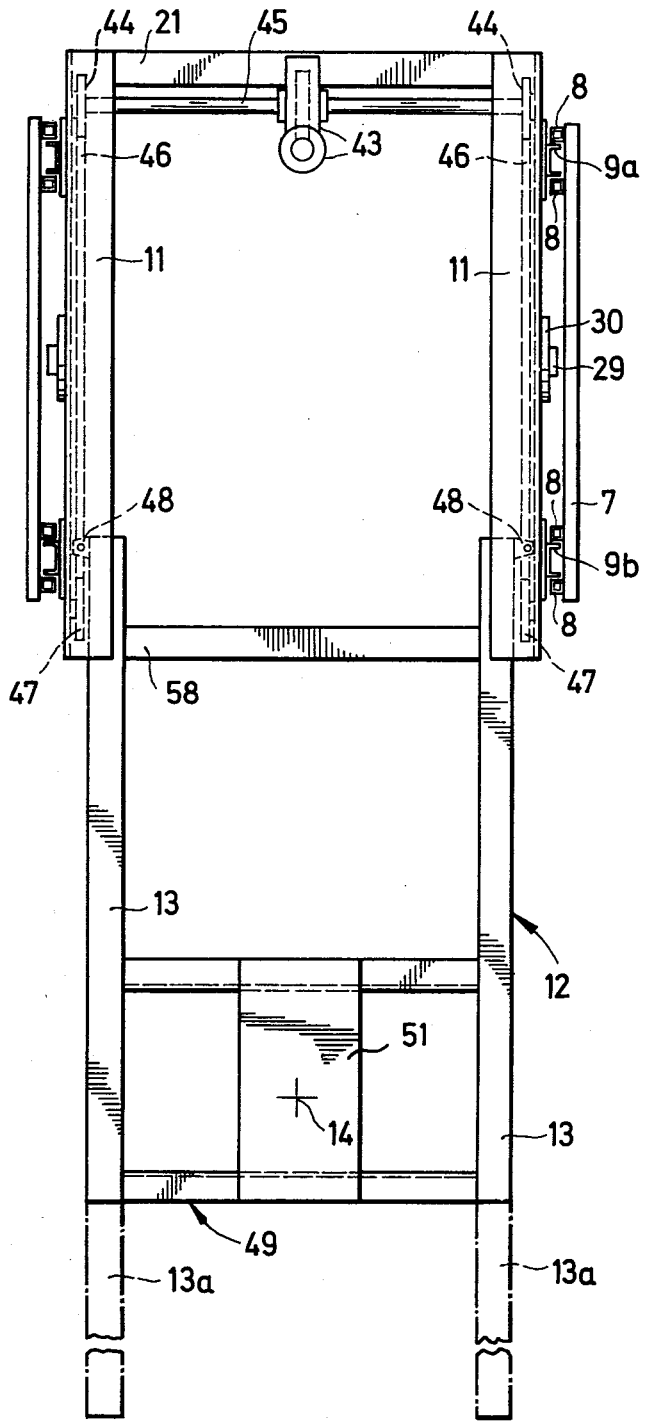
FIG. 4 shows a partial view from above of another embodiment of the invention.

FIG. 4 shows a view from above of the cantilever 12 in the position extended from the frame holding the girder 11. At its end near the rear wall of the garage the girders are joined together by means of the crosspiece 21. The drive mechanism for the cantilever 12 in the embodiment according to FIG. 4 is a chain drive (44–48) in place of the hydraulic cylinders according to FIGS. 1 and 2. The chain drive consists of a worm gear 43 which drives the lateral sprocket wheels 44 through the transmission shaft 45. The chains 46 run from the rear sprocket wheels 44 over front sprocket wheels 47 and are attached by their ends respectively to a strap 48 provided on the rails 13. At the outer sides of the girders 11, at a midway level, is the attachment plate 30 with the joint eye 29 for the connection of the piston end of the lifting cylinder. The design of the yoke 7 which joins the square tube 8 for guiding the guide strips 9*a*, 9*b* was made in FIG. 4 to correspond to the embodiment according to FIG. 1. Between the rails 13 of the cantilever 12 there is attached a frame part 49 containing two transverse strips for receiving the rotating part 17, to which the holding device 5 is attached, as shown in the drawing. At their inner ends the rails 13 are joined together by a transverse strut 58. Compared with the chain drive model the length of the rail 13 to the frame part 49 suffices. Longer rails 13*a* are shown in chain-dotted lines; they are necessary with the use of the single-stage lifting cylinder 18 according to FIGS. 1 to 3 in order to attain the necessary length of stroke.

Figure 5:
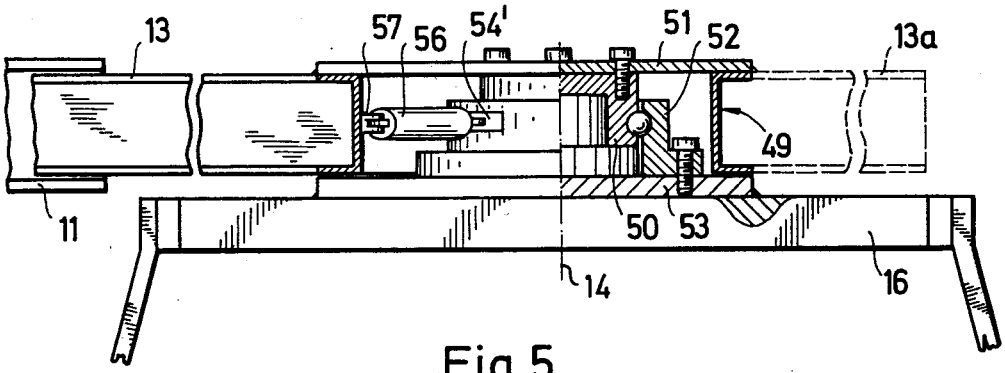
FIG. 5 shows a half-section through the suspension of the holding device along the line V –V in FIG. 6.

FIG. 5 shows a vertical section through the rotating device. In the interior of the frame part 49 is arranged a slewing ring carried on ball bearings, where the inner cage 50 is rigidly joined to the upper plate 51 of the frame part 49, and where the outer cage 52 is rigidly connected with a lower plate 53 on which the transverse part 16 of the suspension of the holding device 5 is attached. On each side of the rotating device 49 run the rails 13, which are guided in the girders 11, without interruption.

Figure 6:
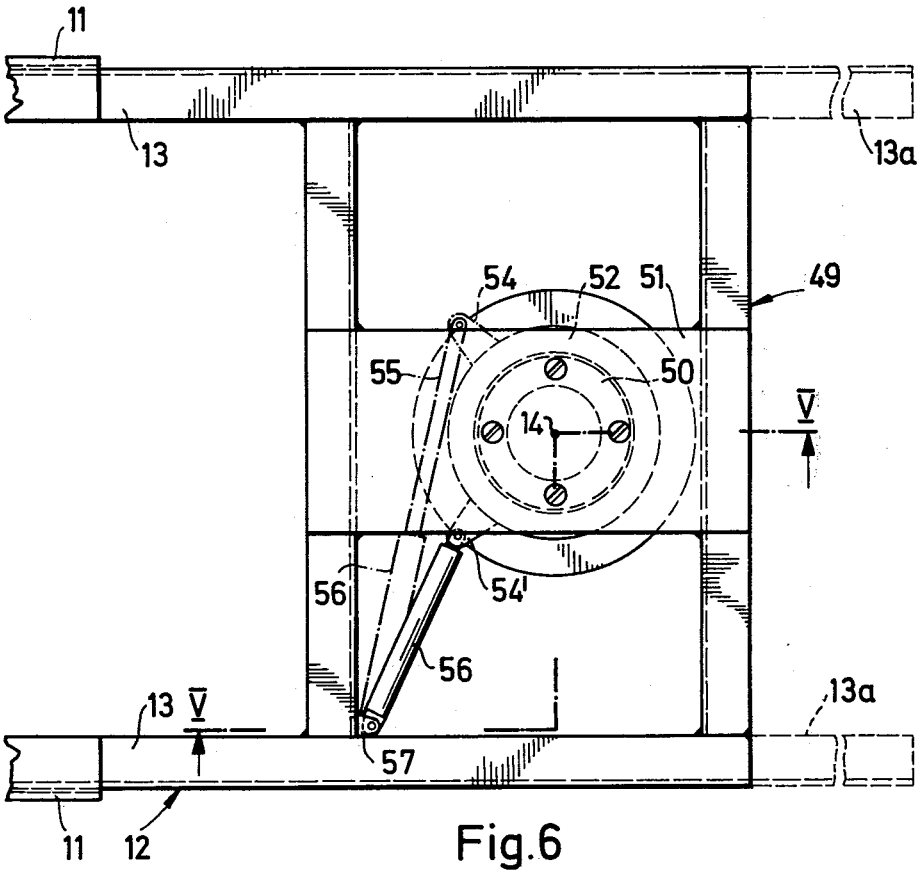
FIG. 6 is the representation according to FIG. 5 seen from above.

According to FIG. 6, in the outer rim 52 of the rotating device is attached a laterally protruding arm 54 to which is attached the end of the piston rod 55 of the hydraulic adjustment piston 56. The cylinder part of the adjustment piston 56 is hinged to an eye 57 attached to the inside of the gallows. The arm 54 is shown in the extended position of the piston rod 55. In the retracted position of the piston rod 55 the same arm is denoted by the reference 54 '. The pivoting angle according to the representation selected is exactly 90 °.

The control of the lifting and lowering movement of the girders 11 and of the horizontal sliding movement of the gallows 12 and of the rotary movement of the holding device can be effected by means of so-called limit switches through which the pump or control valves for the circulation of the hydraulic fluid are actuated. For reasons of strength the device consists mainly of steel constructional parts, whereby the guides can optionally be in the form of metal on metal with grease lubrication, or else as roller guides.

Figure 7:
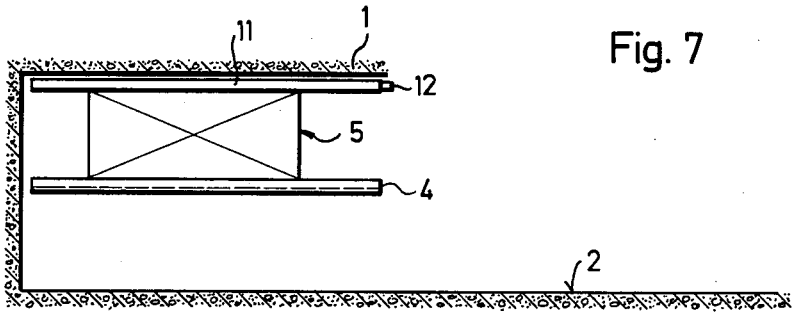
FIGS. 7 to 13 show schematically different forms of loading and unloading of the device.

In principle, several types of charging of the device are conceivable. According to FIGS. 7 to 10, the procedure is as follows:

FIG. 7 shows the empty garage box 1, and the starting position the holding device 5 with the platform 4 is retracted and lifted.

Figure 8:
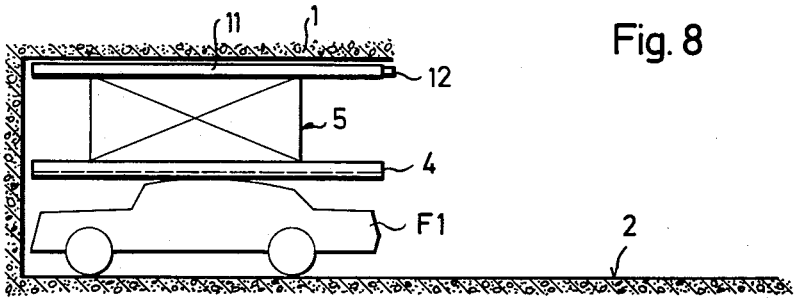
Figure 9:
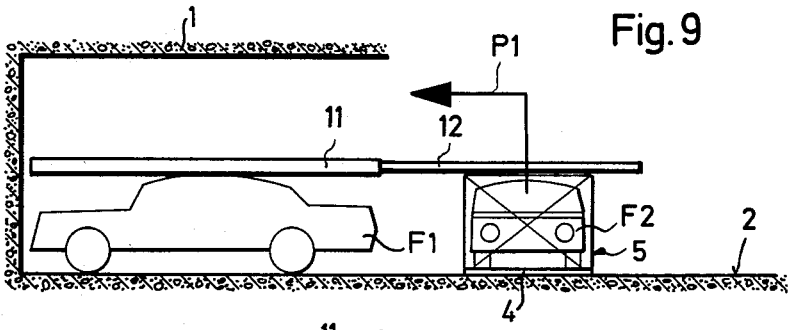
Figure 10:
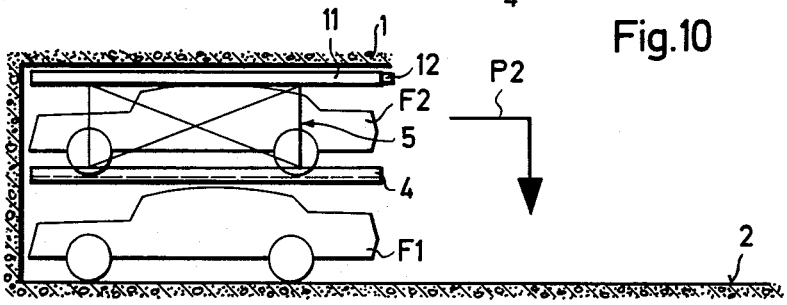
Figure 11:
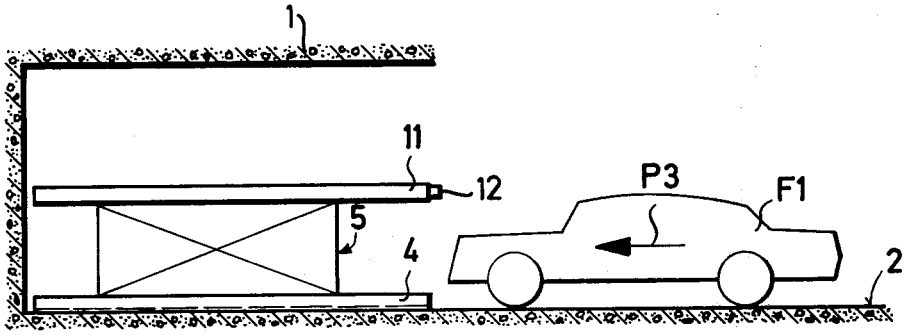

According to FIG. 8, the first incoming vehicle F1 is parked on the garage floor 2 underneath the platform 4 which is still empty. The next vehicle F2 to arrive drives into the holding device 5 which has previously been stationed in front of the garage opening on the garage floor 2, the holding device 5 first extending transversely to the longitudinal direction of the garage (FIG. 9). After this, the girders 11 which act as guides for the cantilever 12 are lifted together with the cantilever 12 and the cantilever 12 is retracted according to the arrow P1. The final position with two parked vehicles F1 and F2 is represented in FIG. 10. The collection of the lower vehicle F1 does not require any machine actuation; the vehicle F2 merely drives out of its station. If vehicle F2 is to be removed before the vehicle F1, the holding device 5 suspended from the cantilever 12 is first moved out horizontally with the platform 4 according to the arrow P2 and is then released by lowering the support 11 and the cantilever 12 onto the floor 2. If, first of all, the vehicle F1 is driven out and then vehicle F2 is called for, by lowering the holding device 5 inside the garage 1 the vehicle F2 is positioned ready to be driven off. It is possible to dispense here with the driving out of the cantilever 12.

Figure 12:
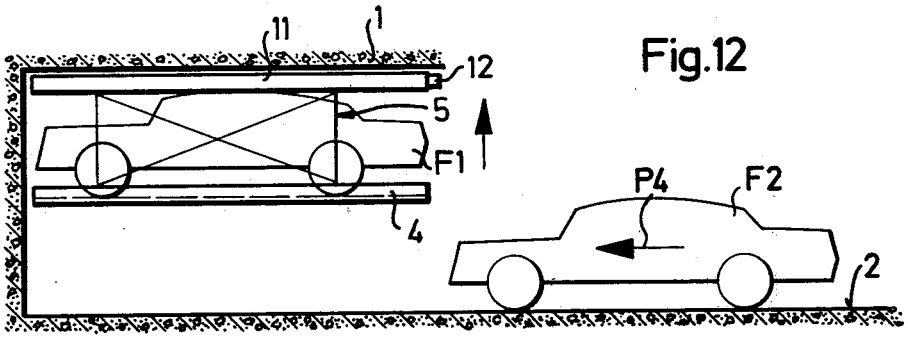
Figure 13:
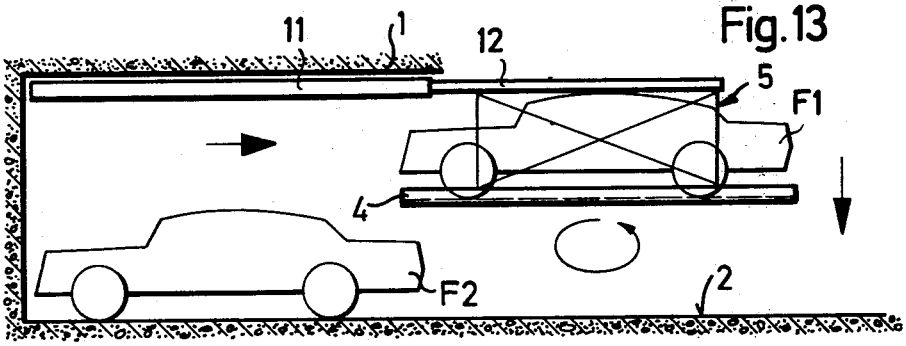

A further possibility of charging the garage arises when the start position for the still empty garage is selected. In this starting position the holding device 5 together with the girders 11 is in the lowered position, the platform 4 being located on the floor 2 of the garage. The first vehicle F1 to enter drives into the holding device according to the arrow P3 and is raised together with the supports 11, at the latest as soon as the incoming vehicle F2 arrives. The vehicle F2 can then occupy the lower parking space by driving into the garage box in the direction of the arrow P4 according to FIG. 12. If after that the vehicle F1 parked above is first called for, this is done by extending the cantilever 12 in the upper position of the girder 11, followed by lowering the holding device 5, while during the lowering or lifting movement of the holding device, the latter can always be pivoted through 90 °, not only for saving space, but also in order to limit the length of extension of the cantilever 12.

I claim:

1. In a garage for parking vehicles, stall means with an entrance end for parking two vehicles one above the other, said stall means defined by two pairs of fixed uprights spaced apart to define the corners of a rectangular space into which a vehicle to be parked a vehicle holding device onto which a vehicle can be driven, horizontal guide rail means within the stall means parallel to the length of the rectangular space, wherein said guide rail means comprises spaced horizontal girders, said vehicle holding device including guide members movable between said girders, means to move said guide members to form extensions of said girders, means for supporting said guide rails means on said uprights for relative vertical movement thereon, said vehicle holding device being mounted on said guide members below said rail means and adjacent said entrance end when said vehicle is driven thereupon or unloaded therefrom, drive means for rotating said holding device about a vertical axis, means for supporting said device on said guide rail means for horizontal movement on said guide rail means into and out of said stall means, means for raising and lowering said guide rail means and said vehicle holding device thereon between a lowermost position wherein a first vehicle can be driven onto said vehicle holding device, to an uppermost position wherein a second vehicle can be driven into said stall means to a position below said first vehicle and said vehicle holding device, and means for moving said vehicle holding device relative to said guide rail means.

2. In a garage as claimed in claim 1, wherein said uprights are hollow, said girders being secured to means telescoping within said uprights.

* * * * *